US005672919A

United States Patent [19]

Johnson et al.

[11] Patent Number: 5,672,919

[45] Date of Patent: Sep. 30, 1997

[54] LOW CURRENT BINARY INPUT SUBSYSTEM

[75] Inventors: Raymond E. Johnson, deceased, late of Coral Springs, Fla.; B. S. Johns, administrator, Nahunta, Ga.; Janusz W. Dzieduszko, Coral Springs, Fla.

[73] Assignee: ABB Power T&D Company Inc., Raleigh, N.C.

[21] Appl. No.: 409,866

[22] Filed: Mar. 24, 1995

[51] Int. Cl.[6] ..... H01H 1/58

[52] U.S. Cl. ..... 307/137; 307/134; 200/242; 335/156; 361/6

[58] Field of Search ..... 307/137, 134; 200/242; 335/156; 361/1, 2, 6

[56] References Cited

U.S. PATENT DOCUMENTS

| | | | |
|---|---|---|---|
| 2,758,223 | 8/1956 | Mueller | 307/137 |
| 3,267,302 | 8/1966 | Breiner et al. | 307/137 |
| 3,794,850 | 2/1974 | Hirose | 307/137 |
| 3,992,636 | 11/1976 | Kiffmeyer | 307/231 |
| 4,086,503 | 4/1978 | Fox et al. | 307/363 |
| 4,134,026 | 1/1979 | Sone et al. | 307/137 |
| 4,480,152 | 10/1984 | Taylor | 179/81 |
| 4,507,571 | 3/1985 | Callan | 307/278 |
| 4,532,466 | 7/1985 | Polinski, Jr. | 323/311 |
| 4,677,308 | 6/1987 | Wroblewski et al. | 307/10 R |
| 4,769,737 | 9/1988 | Ogita et al. | 361/203 |
| 4,851,707 | 7/1989 | Lindsay | 307/137 |
| 5,027,057 | 6/1991 | Mageland et al. | 324/115 |
| 5,182,456 | 1/1993 | Beezley | 250/551 |
| 5,258,654 | 11/1993 | Roberts et al. | 307/115 |
| 5,502,609 | 3/1996 | Thomas et al. | 361/6 |

*Primary Examiner*—William M. Shoop, Jr.
*Assistant Examiner*—Albert W. Paladini
*Attorney, Agent, or Firm*—Woodcock Washburn Kurtz Mackiewicz & Norris LLP

[57] ABSTRACT

Disclosed is a low current binary input subsystem for providing a binary input signal to a data acquisition system. The binary input subsystem monitors the open/close state of a field contact and provides galvanic isolation of noisy field contacts, high noise immunity, a steady state current of approximately 1.2 milliamps resulting in power dissipation of approximately 0.25 watts for a 125 VDC input, and a momentary high current pulse of approximately 150 milliamps for a duration of approximately 4 milliseconds during field contact closure to aid in cleaning of oxides from the field contact.

9 Claims, 2 Drawing Sheets

FIG. 1
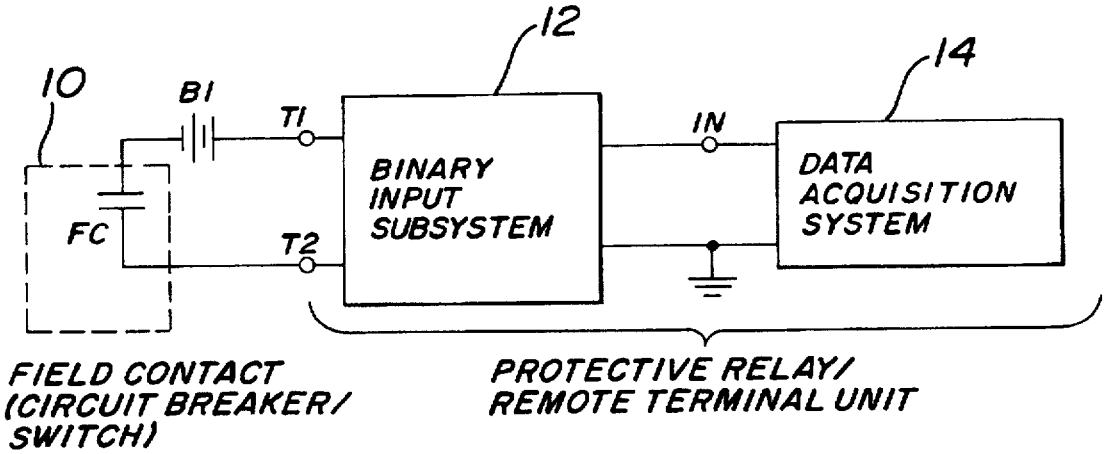
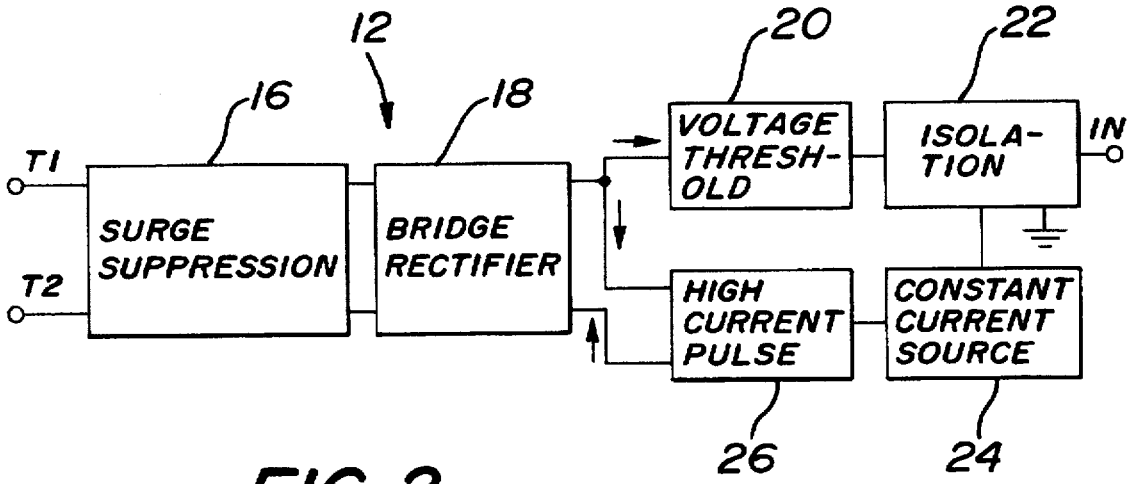
FIG. 2

LOW CURRENT BINARY INPUT SUBSYSTEM

FIELD OF THE INVENTION

The present invention relates generally to the field of data acquisition systems, which monitor the status (position) of switch or relay contacts. More particularly, the present invention relates to a binary input subsystem that employs low current to reduce internal power dissipation and provides a momentary high current during contact closure to aid in contact cleaning.

BACKGROUND OF THE INVENTION

Optically isolated binary input subsystems have been employed in data acquisition systems such as Protective Relays or Remote Terminal Units for a long time. The binary input subsystem senses the open/close position of the field contact and provides a signal indicative thereof to the data acquisition system. U.S. Pat. No. 5,258,654, Nov. 2, 1993, titled "Computer-Checking of the Position of A Switch Whose Contacts Where (sic) Oxidized" (Roberts), discloses a system wherein a computer detects the open/close state of a switch, and a capacitor provides sufficient current to clean the switch contact. U.S. Pat. No. 5,182,456, Jan. 26, 1993, titled "Noise Attenuating Circuit For Mechanical Relay Including Optical Isolation" (Beezley), discloses a noise attenuation circuit for use in AC circuits in conjunction with an electro-mechanical relay, which includes a photocoupler for electrically isolating the direct current relay coil circuit. U.S. Pat. No. 4,532,466, Jul. 30, 1985, titled "Constant Current Source For Field Contact Input" (Polinski), discloses a constant current source for providing a relatively constant DC current through a field input contact. The disclosed circuit also includes electrical isolation between the field input circuitry and a digital system. U.S. Pat. No. 4,507,571, Mar. 26, 1985, titled "Optically Coupled Input Circuit For Digital Controller" (Callan), discloses a circuit for converting AC voltage to a logic level voltage for input to a digital controller. Optical isolation is also included in the disclosed circuitry. U.S. Pat. No. 4,086,503, Apr. 25, 1978, titled "Control Circuit Initiating Conduction of an Opto-Isolator Unit" (Fox), discloses a control circuit for turning on an optical isolation unit.

The above summary of the prior art makes it clear that it is known to use optical isolation in a binary input subsystem of a data acquisition system. Moreover, it is known that a large current may be employed to clean the contacts of a switch or relay. However, prior art binary input subsystems have the following disadvantages: First, they generally have a high power dissipation of approximately 1 to 2 watts per input. Second, the typical steady current flow of approximately 10 milliamps is insufficient to break down the oxide film that often forms on the contact. Accordingly, there is a need for a binary input subsystem that provides galvanic isolation of "noisy" field contacts, high noise immunity, a low steady state current resulting in low power dissipation, and a momentary high current during contact closure to aid in cleaning oxide film from the field contact.

SUMMARY OF THE INVENTION

The present invention achieves the above-stated goals for a binary input subsystem. One presently preferred embodiment of the binary input subsystem provides a steady state current of approximately 1.2 milliamps, resulting in a power dissipation of approximately 0.25 watts for a 125 VDC input. In addition, the presently preferred embodiment provides a momentary high current pulse of approximately 150 milliamps for a duration of approximately 4 milliseconds during field contact closure to aid in cleaning dielectric film from the contact.

The presently preferred embodiment of the invention includes threshold means (e.g., a Zener diode) for receiving an applied voltage and ensuring that the binary input provided to the data acquisition system will remain in an "off" state until the applied voltage exceeds a prescribed threshold; constant current means for ensuring that a prescribed operating current is applied to an isolation means for providing a galvanically isolated binary input signal to the data acquisition system; and current pulse means for providing a current pulse through the contacts when the contacts close, the current pulse being of a designed duration and amplitude sufficient to clean the contacts.

Other features and advantages of the invention are disclosed below.

BRIEF DESCRIPTION OF THE DRAWINGS

FIG. 1 is a block diagram depicting the preferred environment of the present invention.

FIG. 2 is a block diagram of the presently preferred embodiment of a binary input subsystem in accordance with the present invention.

DETAILED DESCRIPTION OF THE PREFERRED EMBODIMENTS

Figure 3:
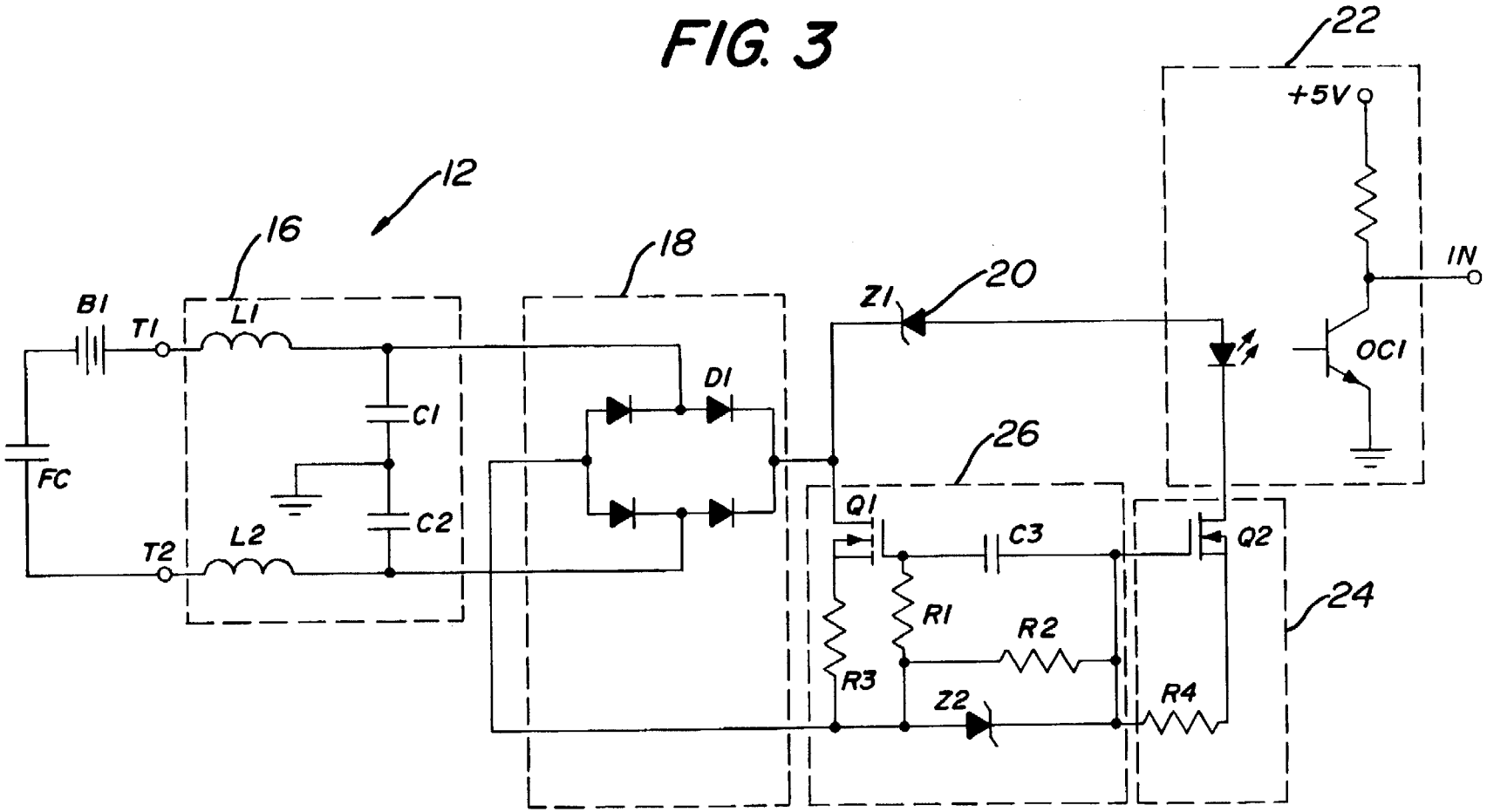
FIG. 3 is a detailed schematic diagram of the embodiment of FIG. 2.

FIG. 1 depicts the preferred application of the present invention. In this application, a field contact (FC) circuit breaker or switch 10 is in series with a station battery B1. A binary input subsystem 12 having input terminals T1, T2 connected respectively to the battery and field contact as shown is employed to provide a binary input signal ("IN") to a data acquisition system 14. The binary input signal "IN" is indicative of the open/close state of the field contact.

FIG. 2 is a block diagram of one presently preferred embodiment of a binary input subsystem 12 in accordance with the present invention. FIG. 3 is a more detailed schematic diagram of the embodiment of FIG. 2. As shown, the preferred embodiment includes a surge suppression circuit 16, a bridge rectifier 18, a voltage threshold component 20, an isolation circuit 22, a constant current source 24, and a high current pulse circuit 26. The isolation circuit 22 provides the binary input signal "IN" to the dam acquisition system. The operation of the preferred embodiment will be clear from the following description of the preferred circuit depicted in FIG. 3.

As shown, the field contact FC and the station B1 are connected to the binary input terminals T1 and T2. The surge suppression circuit 16 comprises inductors L1, L2 and capacitors C1 and C2 arranged as shown to reduce the level of field noise to values tolerable by the data acquisition system 14 (FIG. 1).

The bridge rectifier block 18 comprises a diode bridge D1, which eliminates the need to observe the polarity of the applied battery voltage. In other words, the polarity of the DC current provided to the threshold element 20 (i.e., Zener diode Z1) will be fixed regardless of the polarity of the battery connection to the terminal T1.

The Zener diode Z1 is selected to ensure that the binary input signal will remain in the "off" state (open contact) until the applied voltage exceeds 50% (plus or minus 10%) of the nominal battery voltage. Thus, for a 125 volt battery, the Zener is selected so that it will not conduct until the voltage exceeds 62.5 volts±10%.

The isolation unit 22 comprises a low current optocoupler (OC1) with a nominal 5 volt supply. The output of the isolation unit 22 is the binary input signal "IN" to the data acquisition system 14 (FIG. 1).

The constant current source 24 comprises a depletion mode N channel MOSFET Q2 and a resistor R4 selected to ensure that the correct operating value of current is applied to the optocoupler OC1. The value of the constant current is determined by the feedback resistor R4 and the gate to source voltage of Q2.

The high current pulse unit 26 comprises an enhancement mode N channel MOSFET Q1, a resistor R3, capacitor C3, resistors R1, R2, and Zener diode Z2, which provide a momentary high current pulse through the field contact when the contacts close. The duration of this high current pulse is set by selecting appropriate values of R1 and C3. The amplitude is set by selecting appropriate values of R3 and Z2. The time constant determined by R2 and C3 is selected to limit the duty cycle of the circuit so that it is not thermally overloaded by field contact chatter. The selection of appropriate values for the various resistors, inductors, and diodes is well within the level of ordinary skill in this art, and therefore specific values are not given herein.

The circuitry disclosed herein provides galvanic isolation of noisy field contacts, high noise immunity, a steady state current of approximately 1.2 milliamps, and power dissipation of approximately 0.25 watts for a 125 VDC input, and a momentary high current pulse of approximately 150 milliamps for a duration of approximately 4 milliseconds during field contact closure, which aids in cleaning dielectric (e.g., oxide) film from the field contacts.

The above detailed description of the presently preferred embodiment of the invention is intended to be illustrative, as those skilled in the art will recognize that many variations and modifications of the preferred embodiment will fail within the true scope of the present invention as defined by the following claims.

We claim:

1. A binary input subsystem for providing a binary input signal to a data acquisition system, comprising (a) a pair of terminals (T1, T2) for receiving an electrical signal indicative of the open/close state of contact (FC);

(b) threshold means (20) operatively coupled to said terminals for receiving an applied voltage and ensuring that the binary input will remain in an "off" state until said applied voltage exceeds a prescribed threshold, said "off" state indicating that said contact is open;

(c) isolation means (22) operatively coupled to said threshold means for providing a galvanically isolated binary input signal ("IN") to the data acquisition system;

(d) constant current means (24) operatively coupled to said isolation means for ensuring that a prescribed operating current is applied to said isolation means; and (e) current pulse means (26) operatively coupled to said isolation means for providing a current pulse through said contact when said contact closes, said current pulse being of a designed duration and amplitude sufficient to clean a dielectric film from said contact.

2. A binary input subsystem as recited in claim 1, wherein said prescribed current is less than approximately 5 milliamps.

3. A binary input subsystem as recited in claim 1, wherein said prescribed current is approximately 1.2 milliamps, resulting in a power dissipation of approximately 0.25 watts for a 125 VDC input.

4. A binary input subsystem as recited in claim 1, wherein said current pulse is approximately 150 milliamps for approximately 4 milliseconds.

5. A binary input subsystem as recited in claim 1, wherein said threshold means comprising a Zener diode.

6. A binary input subsystem as recited in claim 1, wherein said isolation means comprises an optocoupler.

7. A binary input subsystem as recited in claim 1, wherein said constant current means comprises a depletion mode MOSFET operatively coupled to said optocoupler and a feedback resistor (R4) coupled to said MOSFET, wherein the value of said constant current is determined by the selection of the resistance of said feedback resistor and the gate-to-source voltage of said MOSFET.

8. A binary input subsystem as recited in claim 1, wherein said current pulse means comprises an enhancement mode MOSFET (Q1) operatively coupled to said threshold means and said terminals (T1, T2), a resistor (R3) coupled to a source of said MOSFET Q1, a capacitor (C3) coupled to a gate of said MOSFET Q1, a resistor (R1) coupled to a gate of said MOSFET Q1 and said capacitor C3, a resistor (R2) coupled to said resistor R1, and a Zener diode (Z2) coupled in parallel to said resistor R2, wherein the duration of said high current pulse is set by the correct selection of R1 and C3, the amplitude of said high current pulse is determined by the selection of correct values of R3 and Z2, and a time constant is set by the selection of R2 and C3 to limit the duty cycle of the circuit so that it is not thermally overloaded by field contact chatter.

9. A binary input subsystem for providing a binary input signal to a data acquisition system, said binary input signal being indicative of the open/close state of field contact (FC), comprising:

(a) a pair of terminals (T1, T2) coupled to a series combination of a battery (B1) in series with said field contact (FC);

(b) circuitry for providing a galvanically isolated binary input signal ("IN") to a data acquisition system while requiring low current during steady state operation and providing a momentary high current pulse to said field contact upon closure of said contact, said circuitry comprising an optocoupler receiving a signal indicative of the open/close state of said field contact and providing a galvanically isolated binary input signal;

(c) a constant current source operatively coupled to said optocoupler for ensuring that said optocoupler consumes a predetermined maximum amount of power; and (d) a high current pulse circuit operatively coupled to said constant current source and to said field contact, said high current pulse circuit providing a momentary high current pulse through the field contact when the contact closes, wherein the duration of the pulse and the amplitude of the pulse are predetermined.

* * * * *